US011286588B2

(12) United States Patent
Ueda et al.

(10) Patent No.: US 11,286,588 B2
(45) Date of Patent: Mar. 29, 2022

(54) INDUSTRIAL TWO-LAYER FABRIC

(71) Applicant: NIPPON FILCON CO., LTD., Tokyo (JP)

(72) Inventors: Ikuo Ueda, Shizuoka (JP); Shinya Murakami, Shizuoka (JP); Hideyuki Yanai, Shizuoka (JP)

(73) Assignee: NIPPON FILCON CO., LTD., Inagi (JP)

( * ) Notice: Subject to any disclaimer, the term of this patent is extended or adjusted under 35 U.S.C. 154(b) by 0 days.

(21) Appl. No.: 16/969,327

(22) PCT Filed: Feb. 8, 2019

(86) PCT No.: PCT/JP2019/004552

§ 371 (c)(1),
(2) Date: Aug. 12, 2020

(87) PCT Pub. No.: WO2019/159829

PCT Pub. Date: Aug. 22, 2019

(65) Prior Publication Data

US 2021/0025085 A1 Jan. 28, 2021

(30) Foreign Application Priority Data

Feb. 15, 2018 (JP) ..... JP2018-024874

(51) Int. Cl.
*D03D 11/00* (2006.01)
*D03D 1/00* (2006.01)
(Continued)

(52) U.S. Cl.
CPC ..... *D03D 11/00* (2013.01); *D03D 1/00* (2013.01); *D21F 1/105* (2013.01); *D10B 2505/00* (2013.01)

(58) Field of Classification Search
CPC ..... D03D 11/00; D03D 1/00; D21F 1/105; D21F 1/0036; D10B 2505/00
See application file for complete search history.

(56) References Cited

U.S. PATENT DOCUMENTS 7,108,019 B2 * 9/2006 Nagura ..... D21F 1/0036 139/383 A
7,270,151 B2 * 9/2007 Nagura ..... D21F 1/0036 139/383 A
(Continued)

FOREIGN PATENT DOCUMENTS

EP 0080686 A1 6/1983
EP 0144530 A2 6/1985
(Continued)

OTHER PUBLICATIONS

International Preliminary Report on Patentability issued in Application No. PCT/JP2019/004552, dated Aug. 18, 2020.
(Continued)

*Primary Examiner* — Robert H Muromoto, Jr.
(74) *Attorney, Agent, or Firm* — Michael Best & Friedrich LLP

(57) ABSTRACT

An industrial two-layer fabric includes an upper surface side fabric constituted by upper surface side warps and upper surface side wefts, one a lower surface side fabric constituted by lower surface side warps and lower surface side wefts, the upper surface side warps include a warp binding yarn, wherein two adjacent upper surface side warps that includes a upper surface side warp that weaves only the upper surface side wefts and the warp binding yarn form a pair, the warp binding yarn of the pair passes below three of the adjacent upper surface side wefts where the warp binding yarn passes below the one of the lower surface side
(Continued)

wefts, a ratio of the number of the upper surface side warps to the number of the lower surface side is 2:1.

8 Claims, 9 Drawing Sheets

(51) Int. Cl.
*D21F 1/10* (2006.01)
*D21F 7/08* (2006.01)

(56) References Cited

U.S. PATENT DOCUMENTS 7,306,014 B2 * 12/2007 Nagura ..... D21F 1/0036 139/383 A
7,357,156 B2 * 4/2008 Ueda ..... D21F 1/0036 139/383 A
7,412,991 B2 * 8/2008 Takimoto ..... D21F 1/0036 139/383 A
7,464,731 B2 * 12/2008 Fujisawa ..... D21F 1/0036 139/383 A
7,507,679 B2 3/2009 Taipale et al.
7,882,857 B1 * 2/2011 Ueda ..... D21F 1/0036 139/383 A
8,205,644 B2 * 6/2012 Ueda ..... D21F 1/0036 139/383 A
2003/0217782 A1 * 11/2003 Nagura ..... D21F 1/0036 139/383 A
2006/0040578 A1 * 2/2006 Nagura ..... D21F 1/0036 442/239
2006/0112999 A1 * 6/2006 Nagura ..... D21F 1/0036 139/383 A
2006/0116042 A1 * 6/2006 Nagura ..... D21F 1/0036 442/205
2006/0260708 A1 * 11/2006 Ueda ..... D21F 1/0036 139/383 A
2007/0095417 A1 * 5/2007 Fujisawa ..... D21F 1/0036 139/383 A
2010/0196670 A1 * 8/2010 Ueda ..... D21F 1/0036 428/172
2011/0011485 A1 * 1/2011 Ueda ..... D21F 1/0036 139/383 A
2021/0025085 A1 * 1/2021 Ueda ..... D03D 11/00
2021/0148015 A1 * 5/2021 Ueda ..... D03D 11/00

FOREIGN PATENT DOCUMENTS

JP 2004-036052 A 2/2004
JP 2004-068168 A 3/2004
JP 2007-520639 A 7/2007
JP 2012-117169 A 6/2012
JP 2012-117170 A 6/2012
JP 2013-501153 A 1/2013
WO 2011/012701 A1 2/2011

OTHER PUBLICATIONS

International Search Report issued in Application No. PCT/JP2019/004552, dated Apr. 16, 2019.
Extended Search Report issued in European Application No. 19754965.2, dated Jun. 18, 2021.
Office Action issued in Japanese Application No. 2018-024874, dated Jan. 25, 2022.

* cited by examiner

INDUSTRIAL TWO-LAYER FABRIC

TECHNICAL FIELD OF THE INVENTION

The present invention relates to an industrial two-layer fabric which is capable of adjusting the hydration speed by restricting the initial hydration volume, while at the same, of increasing the hydration volume by making a state of the inside structure low water retentive. In particular, the present invention relates to an industrial two-layer fabric which exhibits basic properties such as good wear resistance, good hydration property and good surface smoothness so as to make it difficult for the wire mark to be to transferred, so as to be applied to a high speed water making machine.

BACKGROUND ART

Fabrics obtained by weaving warps and wefts have conventionally been used widely as an industrial fabric. They are, for example, used in various fields including papermaking fabrics, conveyor belts and filter cloths and are required to have fabric properties suited for the intended use or using environments. Of such fabrics, a papermaking fabric used in a papermaking step for removing water from raw materials by making use of the network of the fabric must satisfy a severe demand.

For example, there is a demand for the development of fabrics which do not transfer a wire mark of the fabric and therefore have excellent surface property, the ones which have enough hydration property for sufficiently and uniformly hydrating excess water contained in the material and enough rigidity or wear resistance to be usable desirably even under severe environments, or the ones which are capable of maintaining conditions necessary for making good paper for a prolonged period of time.

In addition, fiber supporting property, improvement in a paper making yield, dimensional stability and running stability are demanded.

In recent years, owing to the speed-up of a paper making machine, requirements for papermaking fabrics become severe further.

Since most of the demands for industrial fabrics and solutions thereof can be understood if papermaking fabrics on which the most severe demand is imposed among industrial fabrics is described, the papermaking fabric will hereinafter be described as a representative example.

Recently, the relationship between the hydration property and the water retentive property of the fabric becomes important due to the high speed operation of a papermaking machine, and the removal of the material and the high yield are required. Such being the case, it is necessary to secure an inter space between the upper and lower layers. In order to adjust the hydration property and the water retentive property, the fabric in which the warp binding yarns are used, as disclosed in Patent Publication 1, for example. More specifically, in Patent Publication 1, two-layered fabric in which a part of the warps functions as basic yarns which weave a layer on the upper surface side and the one on the lower surface side as binding yarns, in such a way that the longitudinal binding yarns forming a pair complement the warps structure on the upper surface side and the ones on the lower surface side. According to the above fabric, since the various surface structures are formed, the excellent surface smoothness and the excellent binding strength are attained.

In addition, in order to attain the uniform hydration property, Patent Publication 2 discloses the two-layered fabric in which a pair of the warp on the upper surface side and the warp binding yarn are arranged. The uniform structure is formed on the surface by combining the knuckle on the upper surface side of the warp biding yarns weaving the upper and lower surfaces, with the warp structure on the upper surface side. According to the above fabric, the collapse of the structure can be prevented due to the fact that two warps cooperate with each other to form a structure by one single warp on the surface, but one or both of the warps related to the warp structure has to be collapsed, so that one or both of the warps forms a cross portion when they run up and down. In addition, a pair of two warps are arranged as one single warp, so that meshes are closed near a position where the warp binding yarn is woven with the weft on the upper surface, since two warps are not arranged along a line of one single warp, but arranged laterally in parallel. Such being the case, the generation of the wire marks can be caused due to the change of the hydration property of the wire.

Still further, since hydration holes, each of which completely penetrates from the layer on the upper surface side to the layer on the lower surface side, are arranged on the whole surface of such a fabric, the hydration property is good, but it is known that the sheet material on the wire can stick to the fabric or the removal of the fiber or the filler can be caused, due to the strong vacuum operation, whereby the hydration marks can be conspicuously generated.

Still further, the volume of the water retention can be reduced by the thickness of the net being thinned, but there is a risk that the size of mesh can be so small that the hydration property can be deteriorated, in a case where the thickness of the net is thinned by the diameter of the yarn being reduced.

On the other hand, in a case where an on-stack structure by the longitudinal yarns is adopted, the hydration speed can be enhanced, but the hydration property can be restricted if the density of the lateral yarns is set to be high in order to restrict the original hydration.

Still further, the thickness of the mesh can be reduced by setting the diameter of the warp constituting the fabric on the upper surface side to be smaller than the diameter of the warp constituting the fabric on the lower surface side, but the compatibility of the restriction of the hydration and the restriction of the thickness of the net becomes technically difficult, since the space formed by the warps on the front 面 becomes bigger than the space formed by the warps on the underside surface, in the two-layered fabric in which upper layer and the lower layers whose diameter is different from the one of the upper layer.

On the other hand, the technique for adjusting the volume of the hydration is disclosed in Patent Publication 3. By such a technique, the technical problem that the surface structure can be collapsed by the fact that two warps on the upper surface side and the binding yarns are combined with each other to form a structure for a one single warp, so that upper and lower warps are replaced or cooperate with each other. Accordingly, the generation of the hydration marks and the generation of the wire marks can be restricted by binding the upper and lower nets by means of the warp.

However, since it is necessary to provide a structure in which the warp on the upper surface side and the warp on the lower surface side are arranged upper and lower sides, respectively, on each of a plurality of locations, in order to secure the rigidity, etc. of the net, the ratio of the warps constituting the upper net to the warps constituting the lower net becomes too high.

That is to say, in the technique in Patent Publication 3, the technical problem that the shortage of the rigidity and the tendency of the extension of the fabric caused by the number of the warps on the lower surface side is smaller than the number of the warps on the upper surface side can be solved. In addition, there is a risk that technical problem that an evenness of the hydration path, and thus, the generation of the hydration marks, due to the existence of the location where the warp on the lower surface side is positioned below the two warps on the upper surface side forming a pair and the location where the warp on the lower surface side is not positioned below the two warps on the upper surface side forming a pair can be caused.

The present inventor made an effort to develop the fabric which is capable of setting the diameter of the lateral yarns to cause the difference of the density of the lateral yarns by making the space rate of the upper longitudinal yarns close to the space rate of the lower longitudinal yarns, in order to solve the above technical problems caused by the prior art technique.

Patent Publication 1: Japanese Patent Laid-open Publication 2004-36052

Patent Publication 2: Japanese Patent Laid-open Publication 2004-68168

Patent Publication 3: Japanese Patent Laid-open Publication 2012-117169

DISCLOSURE OF THE INVENTION

Technical Problems to be Solved by Present Invention

The object of the present invention is to provide a fabric with a thinned thickness which exhibits excellent rigidity, good anti-extension property, good wear resistance, good hydration property and good surface smoothness property, like a fabric forming a surface structure by flat yarns.

The object of the present invention is to provide an industrial two-layer fabric which is capable of adjusting the hydration property by a selection of the diameter of the yarns.

The object of the present invention is to provide a fabric which is capable of alleviating stress on the lateral yarns by which knuckles are retracted, while at the same time, of largely improving the density of the lateral yarns.

The object of the present invention is to provide an excellent fabric which is capable of minimizing the generation of the unevenness of the hydration inside the fabric formed by conventional warp binding yarns in which the diameter of the binding yarns running up and down inside the fabric is reduced.

The object of the present invention is to provide an excellent fabric which is capable of adjusting the hydration speed without the thickness of the net being reduced.

The object of the present invention is to provide a fabric which is capable of controlling the hydration speed by appropriately closing the mesh of the fabric on the upper surface side by two ribbed cords to restrict the difference of the excessive flow volume of water at the space between the upper and lower layer.

The object of the present invention is to provide a fabric with two warps forming a pair which is capable of minimizing the collapse of the structure of the binding portion by the one of two warps on the upper surface side, while by making at least the other of two warps the binding yarn to form a fabric structure as well as a binding structure.

Means to Solve Technical Problems

The industrial two-layer fabric of the present invention includes following technical features in order to solve the above technical problems.

(1) The industrial two-layer fabric with a complete structure of the present invention includes one upper surface side fabric constituted by warps on the surface side and upper surface side wefts, one lower surface side fabric constituted by lower surface side warps and lower surface side wefts, at least one warps on the surface side function as a warp binding yarn, two warps on the upper surface side are woven to form a pair on the upper surface side as the ribbed cord fabric, a ratio of the number of the warps on the upper surface side to that of the warps on the lower surface side is 2:1.

According to the present invention with the above elements, a suitable rigidity and anti-extension property are obtained without a thickness being enhanced. In particular, since the ratio of the warp on the upper surface side to the warps on the lower surface side is 2:1, unevenness of the hydration paths and the generation of the hydration marks, etc. can be prevented due to that the warp on the lower surface side never fails to exist below the pair of two warps on the upper surface side.

(2) Among one of the two warps on the upper surface side forming a pair, all the yarns is woven with each other as the ribbed cord fabric to be arranged in parallel, in a pair which do not include the warp binding yarn.

(3) Among one of the two warps on the upper surface side forming a pair, a part of the yarns is so woven as the ribbed cord fabric to be arranged in parallel, and one of the two warps is the warp binding yarn.

(4) Among one of the two warps on the upper surface side forming a pair, a part of the yarns is so woven with each other as the ribbed cord fabric to be arranged in parallel, in a pair each of which is the warp binding yarn. The cooperation by the parallel arrangement means a situation in which a part of knuckles emerging on the front surface formed by adjacent warp binding yarns, while, each of other knuckles are formed by one single warp binding yarn. In addition, the knuckle formed by the one single warp is replaced at a portion which is woven in parallel, which constitute a technical feature.

(5) In the pair of warps which form the warp biding yarn, 50% or more of the yarns are woven as the ribbed cord fabric to be arranged in parallel. The above ratio in the present invention means a numerical value based on the number of the knuckles emerging on the surface of the fabric on the upper surface side.

For instance, in a case where one single warp on the upper surface side forming a pair includes six knuckles, while, other warps on the upper surface side includes three knuckles, 50% of the yarns are woven with each other to be arranged in parallel.

(6) The diameter of the warps on the upper surface side are set to the same, while, the diameter of the warps on the lower surface side are set to the same, and the ratios of the diameter of the warp on the lower surface side to the one on the upper surface side is 150% to 300%. Excellent rigidity and anti-extension property can be obtained by such a structure.

(7) The longitudinal density of the warps constituting the fabric on the upper surface side is 40% to 60%, while that on the lower surface side is 40% to 55%. The longitudinal density means the ratio of occupying the space of the warps constituting the fabric. In a case where the longitudinal density is below 40%, there is a risk of the hydration or the removal of the product. On the other hand, in a case where the longitudinal density on the upper surface side exceeds 60%, or that longitudinal density on the lower surface side exceeds 55%, there is a risk of the deterioration of the hydration, or the clogging, etc. Excellent hydration property can be obtained by such a structure.

Effect of the Invention

According to the industrial two-layer fabric of the present invention, excellent air permeability with good wear resistance to prevent the wire mark or the hydration mark can be obtained, while high rigidity can be exhibited.

According to the present invention, a fabric with a thinned thickness which exhibits excellent rigidity, good anti-extension property, good wear resistance, good hydration property and good surface smoothness property, like a fabric forming a surface structure by flat yarns, can be provided.

According to the present invention, an industrial two-layer fabric which is capable of adjusting the hydration property by a selection of the diameter of the yarns can be provided.

According to the present invention, a fabric which is capable of alleviating stress on the lateral yarns by which knuckles are retracted, while at the same time, of largely improving the density of the lateral yarns can be provided.

According to the present invention, an excellent fabric which is capable of minimizing the generation of the unevenness of the hydration inside the fabric formed by conventional warp binding yarns in which the diameter of the binding yarns running up and down inside the fabric is reduced can be provided.

According to the present invention, an excellent fabric which is capable of adjusting the hydration speed without the thickness of the net being reduced can be provided.

According to the present invention, a fabric which is capable of controlling the hydration speed by appropriately closing the mesh of the fabric on the upper surface side by two ribbed cords to restrict the difference of the excessive flow volume of water at the space between the upper and lower layer can be provided.

According to the present invention, a fabric with two warps forming a pair which is capable of minimizing the collapse of the structure of the binding portion by the one of two warps on the upper surface side, while by making at least the other of two warps the binding yarn to form a fabric structure as well as a binding structure can be provided.

DETAILED DESCRIPTION OF THE INVENTION

Figure 1:
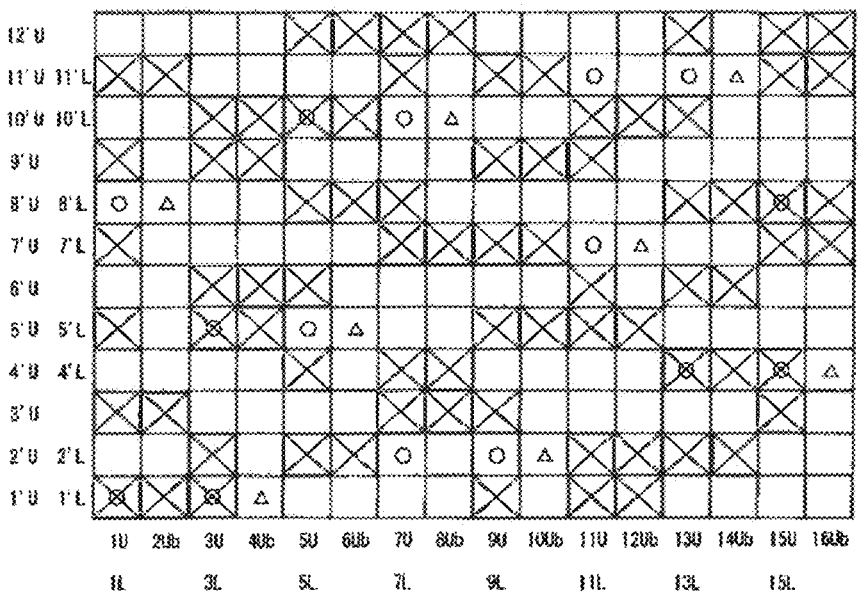
FIG. 1 is a design view showing a complete structure of the first embodiment according to the present invention.

Now, the structure and the effect of the two-layer fabric of the present invention will be described below. Embodiments of the two-layer fabric of the present invention will be described thereafter with reference to the drawings.

The industrial two-layer fabric with a complete structure of the present invention includes at least one upper surface side fabric constituted by warps on the surface side and upper surface side wefts, at least one lower surface side fabric constituted by lower surface side warps and lower surface side wefts, at least one or more warps on the surface side function as a warp binding yarn, two warps on the upper surface side are woven with each other to form a pair on the upper surface side as the ribbed cord fabric, a ratio of the warp on the upper surface side to the warps on the lower surface side is 2:1.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

As the warps on the surface side, lower surface side warps, and upper surface side wefts, use of a polyester monofilament having rigidity and excellent dimensional stability is usually preferred. When lower surface side wefts which need wear resistance are obtained by interweaving of polyester monofilaments and polyamide monofilaments while arranging them alternately, they are able to have wear resistance without losing rigidity.

It is also possible to place a plurality of yarns with the same design at a position where one yarn is normally placed from the standpoint of design. Design of a plurality of yarns having a thin diameter brings about improvement in surface property and thinning of the fabric.

Among one of the two warps on the upper surface side forming a pair, all the yarns may be so woven with each other as the ribbed cord fabric to be arranged in parallel, in a pair which do not include the warp binding yarn.

Among one of the two warps on the upper surface side forming a pair, a part of the yarns may be so woven with each other as the ribbed cord fabric to be arranged in parallel, in a pair which do not include the warp binding yarn.

Among one of the two warps on the upper surface side forming a pair, a part of the yarns may be so woven with each other as the ribbed cord fabric to be arranged in parallel, in a pair each of which is the warp binding yarn.

In the pair of warps which form the warp biding yarn, 50% or more of the yarns may be woven with each other as the ribbed cord fabric to be arranged in parallel.

Since the surface structure can be formed lime flat yarns by adopting such a structure, the thickness of the two-layered fabric can be restricted.

In addition, since the size of the mesh can be adjusted so as to be made small without the thickness being enhanced, the hydration property different from the conventional hydration property can be obtained.

Still further, the tension force caused by the knuckle in the wefts woven with two warps, the density of the lateral yarns can be enhanced.

Still more further, in the present invention, since the fabric structure can be constituted by two warps and includes a biding structure, in the binding yarns, the one of the pair of the binding constitutes a fabric structure, and a binding structure as well, while, the other of the pair on the surface side can minimize the collapse of the fabric structure of the binding portion.

Still more further, the diameter of the warps on the upper surface side may be set to be the same, while, the diameter of the warps on the lower surface side are set to be the same, and the ratios of the diameter of the warp on the lower surface side to the one on the upper surface side may be 150% to 300%.

By adopting such a structure, since the binding of the two layers can be effected by one of the yarns of the ribbed cord fabric with comparatively thin two warps, the diameter of the binding yarn running up and down inside the fabric can be made smaller than that of the warp constituting the normal warp binding yarn.

Therefore, the generation of the unevenness of the hydration can be minimized. In addition, the thickness of the net has been conventionally controlled by reducing the diameter of the yarn constituting the fabric, and, in case of the two-layered fabric with the diameter of the upper and the lower yarns different from each other.

The space of the warps on the front surface side is larger than that on the underside surface, so that the compatibility between the restriction of the hydration and the restriction of the thickness of the net was technically difficult.

In the present invention, by adopting yarns with a small diameter, the hydration speed can be adjusted with the thickness of the net being maintained.

The longitudinal density of the warps constituting the fabric on the upper surface side is 40% to 60%, while that on the lower surface side is 40% to 55%. The longitudinal density means the ratio of occupying the space of the warps constituting the fabric.

In this connection the diameter of the warp on the warp structure on the upper surface side constituting a pair may be set smaller than the diameter of the warp of the warp structure on the upper surface side constituting a single yarn. By making the diameter of the pair, the force exerted on the weft when a knuckle is formed can be almost the same as the force in case of one single yarn, so that the surface smoothness, the fiber supportability, etc. can be improved. In addition, since the diameter of the yarn can be adjusted by selecting the one along with its material, the diameter and the material of the yarn can be appropriately selected.

Still further, in the present invention, the on-stack structure may be adopted. The high hydration property can be obtained by such an on-stack structure, while, the hydration speed can also be controlled, since the surface structure is constituted by the ribbed cord fabric, so that the mech can be suitably closed by the two yarns so as to restrict the excessive difference between the space of the front surface and the space of the underside surface.

Now, the embodiments of the present invention will be described below with reference to the drawings. Each of FIGS. 1 to 12 is a design view showing a complete structure of an embodiment of the present invention. Here, the design view corresponds to the complete structure of the fabric defining the minimum unit to be repeated of the fabric structure. The fabric recited in the claims corresponds to this complete structure. The final product is completed by combining any number of such complete structures in the longitudinal direction and the direction perpendicular to the longitudinal direction.

In each of the design views, the warp is indicated by a reference number such as 1, 2, 3 . . . . The upper and lower warps are indicated by the reference number to which U and D are attached, respectively.

The weft is indicated by a reference number such as 1', 2', 3'. The upper surface side weft and the lower surface side weft are indicated by the reference number to which u and d are attached, respectively, such as 1'*u*, 2'*d*, etc. In addition, the binding weft yarn and the auxiliary weft are indicated by the reference number to which b and f are attached, respectively, such as 1'*u*, 1'*d*, 2'*b*, 2'*f*, etc.

In each of the design views, a symbol "x" indicates that the upper surface side warp is arranged above the upper surface side weft or the auxiliary weft, a solid triangle symbol "Δ" indicates that the binding yarn is arranged below the lower surface side weft, and a symbol "○" indicates that the lower surface side warp is arranged below the lower surface side weft.

The warps and the wefts on the upper surface side are arranged to be overlapped with the warps and the wefts on the lower surface side, respectively. In this connection, in the design view, the warps and the wefts on the upper surface side are depicted to be precisely arranged over the warps and the wefts on the upper surface side, because of the clarity of the drawing. In the real fabric, it does not matter if they are arranged to be offset.

First Embodiment

FIG. 1 is a design view showing an industrial two-layer fabric according to the first embodiment. One of the warps on the upper surface side forming a pair in the first embodiment is the warp binding yarn. A part of the yarns are arranged to be in parallel so as to form a cord rib in the pairs of the warps on the upper surface side. The ratio of the wefts on the upper surface side to the wefts on the lower surface side is 3:2.

In addition, in the pairs of the warps on the upper surface side one of which is the warp binding yarn, 50% of the knuckles are arranged to be in parallel on the surface.

Figure 2:
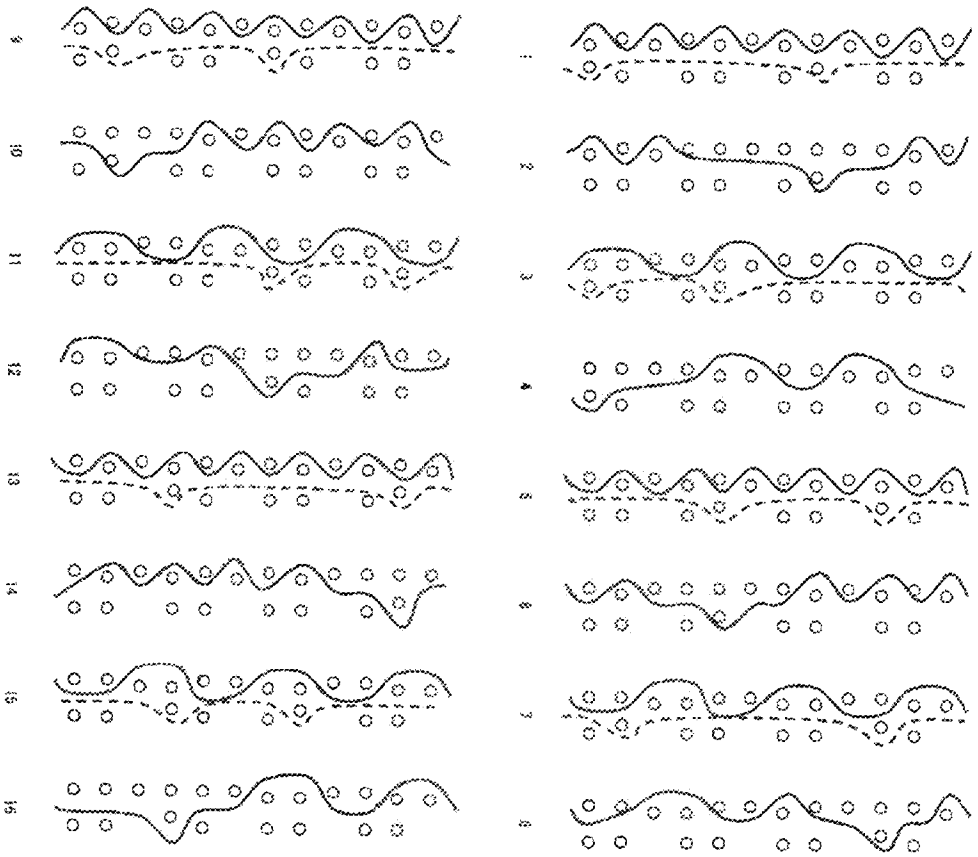
FIG. 2 is a design view showing a condition of the warps the first embodiment according to the present invention.

More specifically, as shown in FIG. 2, the warps on the upper surface side 1U and 2Ub, 3U and 4Ub, 5U and 6Ub, 7U and 8Ub, 9U and 10Ub, 11U and 12Ub, 13U and 14Ub, and 15U and 16Ub form a pair to constitute a structure of the fabric on the upper surface side. The warp 1U on the upper surface side forms a plain fabric of 1/1. The binding warp 2Ub forming a pair with the warp 1U passes above the weft 1'U on the upper surface side, below the weft 2'U on the upper surface side, above the weft 3'U on the upper surface side, below the weft 8'U on the lower surface side, and above the weft 11'U on the upper surface side.

The warp 3U on the upper surface side forms a plain fabric of 2/2. The binding warp 4Ub forming a pair with the warp 3U passes below the weft 1'L on the lower surface side, above the wefts 5'U, 6'U on the upper surface side, below the wefts 7'U, 8'U on the upper surface side, above the wefts 9'U,10'U on the upper surface side, and below the wefts 11'U,12'U on the upper surface side.

The warp 5U on the upper surface side forms a plain fabric of 1/1. The binding warp 6Ub forming a pair with the warp 5U passes below the weft 1'U on the upper surface side, below the weft 5'L on the lower surface side, and above the wefts 8'U,10'U,12'U on the upper surface side.

The warp 7U on the upper surface side forms a plain fabric of 2/2. The binding warp 8Ub forming a pair with the warp 7U passes below the wefts 1'U, 2'U on the upper surface side, above the wefts 3'U,4'U on the upper surface side, below the wefts 5'U, 6'U on the upper surface side, above the weft 7'U on the upper surface side, below the weft 10'L on the lower surface side, and above the weft 12'U on the upper surface side.

In addition, the warp 9U on the upper surface side forms a plain fabric of 1/1. The binding warp 10Ub forming a pair with the warp 9U passes below the weft 1'U on the upper surface side, below the weft 2'L on the lower surface side, and above the weft 5'U, 7'U, 9'U, 11'U on the upper surface side.

The warp 11U on the upper surface side forms a plain fabric of 2/2. The binding warp 12Ub forming a pair with the warp 11U passes above the wefts 1'U, 2'U on the upper surface side, below the weft 3'U, 4'U on the upper surface side, above the weft 5'U on the upper surface side, below the weft 7'L on the lower surface side, and above the weft 10'U on the upper surface side.

The warp 13U on the upper surface side forms a plain fabric of 1/1. The binding warp 14Ub forming a pair with the warp 13U passes above the wefts 2'U, 4'U,6'U,8'U on the upper surface side, below the weft 11'L on the lower surface side, and above the wefts 8'U,10'U,12'U on the upper surface side.

The warp 15U on the upper surface side forms a plain fabric of 2/2. The binding warp 16Ub forming a pair with the warp 15U passes below the wefts 1'U,2'U,3'U on the upper surface side, below the weft 4'L on the lower surface side, above the wefts 7'U,8'U on the upper surface side, below the wefts 9'U,10'U on the lower surface side, and above the wefts 11'U, 12'U on the upper surface side.

In the first embodiment, by adopting the ribbed cord fabric as a part of the surface of the fabric on the upper surface side, a fabric with a thinned thickness which exhibits excellent rigidity, good anti-extension property, good wear resistance, good hydration property and good surface smoothness property, like a fabric forming a surface structure by flat yarns can be provided.

In addition, by adopting the fabric structure of the first embodiment, since the size of the mesh can be reduced without the thickness of the fabric being enhanced, the hydration property can be adjusted by a selection of the diameter of the yarns.

Still further, by two ribbed cord portion, since stress on the lateral yarns by which knuckles are retracted can be alleviated, the density of the lateral yarns can be largely improved.

Second Embodiment

Figure 3:
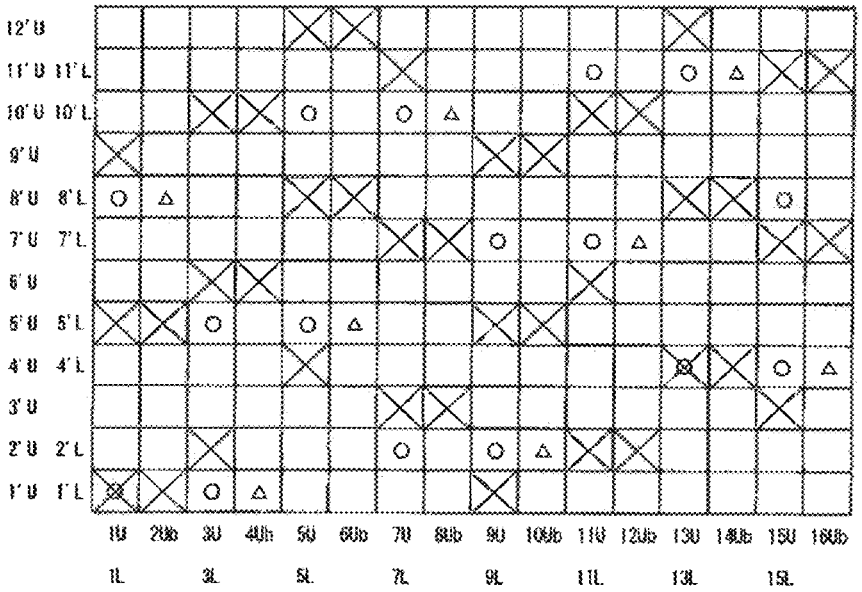
FIG. 3 is a design view showing a complete structure of the second embodiment according to the present invention.

FIG. 3 is a design view showing an industrial two-layer fabric according to the second embodiment. One of the warps on the upper surface side forming a pair in the first embodiment is the warp binding yarn. A part of the yarns are arranged to be in parallel so as to form a cord rib in the pairs of the warps on the upper surface side. The ratio of the wefts on the upper surface side to the wefts on the lower surface side is 3:2.

In addition, in the pairs of the warps on the upper surface side one of which is the warp binding yarn, 50% of the knuckles are arranged to be in parallel on the surface.

Figure 4:
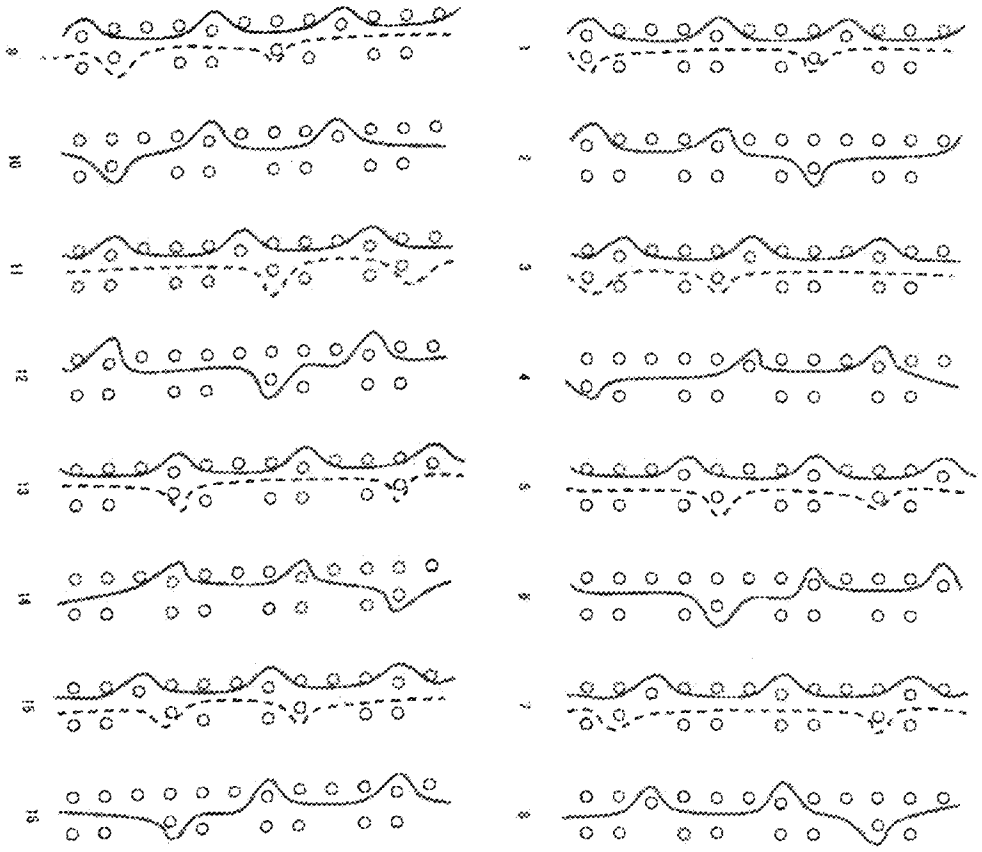
FIG. 4 is a design view showing a condition of the warps the second embodiment according to the present invention.

More specifically, as shown in FIG. 4, the warps on the upper surface side 1U and 2Ub, 3U and 4Ub, 5U and 6Ub, 7U and 8Ub, 9U and 10Ub, 11U and 12Ub, 13U and 14Ub, and 15U and 16Ub form a pair to constitute a structure of the fabric on the upper surface side. The warp 1U on the upper surface side forms a plain fabric of ⅓. The binding warp 2Ub forming a pair with the warp 1U passes above the wefts 1'U,5'U on the upper surface side, and below the weft 8L' on the lower surface side. The warp 3U on the upper surface side forms a plain fabric of ⅓. The binding warp 4Ub forming a pair with the warp 3U passes below the weft 1'L on the lower surface side, and above the wefts 6'U, 10'U on the upper surface side. The warp 5U on the upper surface side forms a plain fabric of ⅓. The binding warp 6Ub forming a pair with the warp 5U passes below the weft 5'L on the lower surface side, and below the wefts 8'L, 12'L on the lower surface side. The warp 7U on the upper surface side forms a plain fabric of ⅓. The binding warp 8Ub forming a pair with the warp 7U passes above the wefts 3'U, 7'U on the upper surface side, and below the weft 10'L on the lower surface side.

In addition, the warp 9U on the upper surface side forms a plain fabric of ⅓. The binding warp 10Ub forming a pair with the warp 9U passes below the weft 2'L on the lower surface side, and above the wefts 5'U, 9'U on the upper surface side. The warp 11U on the upper surface side forms a plain fabric of ⅓. The binding warp 12Ub forming a pair with the warp 11U passes above the weft 2'U on the upper surface side, below the weft 7'L on the lower surface side, and above the weft 10'U on the upper surface side. The warp 13U on the upper surface side forms a plain fabric of ⅓. The binding warp 14Ub forming a pair with the warp 13U passes above the wefts 4'U,8'U on the upper surface side, and below the weft 11'L on the lower surface side. The warp 15U on the upper surface side forms a plain fabric of ⅓. The binding warp 16Ub forming a pair with the warp 15U passes below the weft 4'L on the lower surface side, and above the wefts 7'U, 11'U on the upper surface side.

In the second embodiment, by adopting the ribbed cord fabric as a part of the surface of the fabric on the upper surface side, a fabric with a thinned thickness which exhibits excellent rigidity, good anti-extension property, good wear resistance, good hydration property and good surface smoothness property, like a fabric forming a surface structure by flat yarns can be provided.

In addition, by adopting the fabric structure of the second embodiment, since the size of the mesh can be reduced without the thickness of the fabric being enhanced, the hydration property can be adjusted by a selection of the diameter of the yarns.

Still further, by two ribbed cord portions, since stress on the lateral yarns by which knuckles are retracted can be alleviated, the density of the lateral yarns can be largely improved.

Third Embodiment

Figure 5:
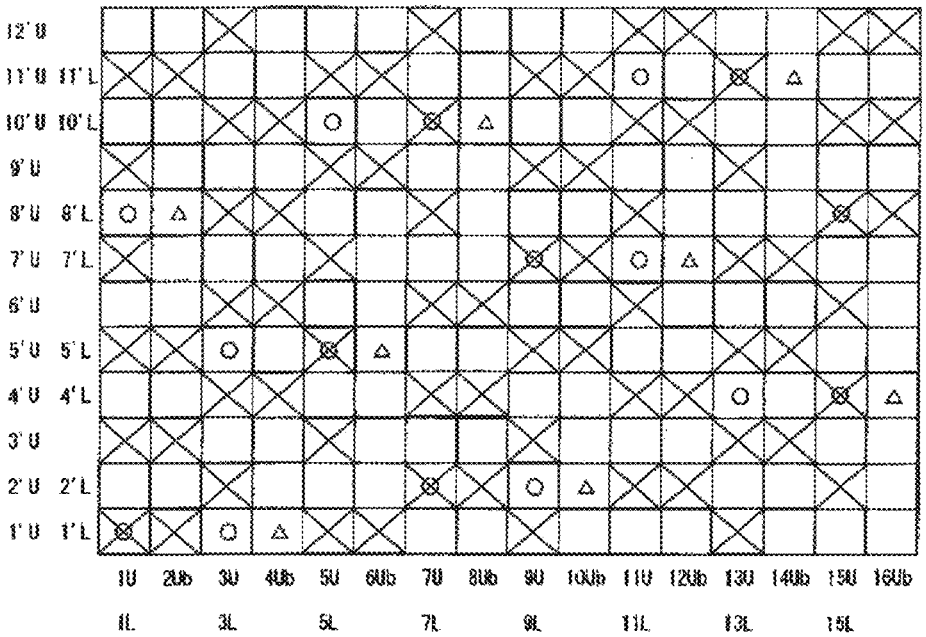
FIG. 5 is a design view showing a complete structure of the third embodiment according to the present invention.

FIG. 5 is a design view showing an industrial two-layer fabric according to the third embodiment. One of the warps on the upper surface side forming a pair in the first embodiment is the warp binding yarn. A part of the yarns are arranged to be in parallel so as to form a cord rib in the pairs of the warps on the upper surface side. The ratio of the wefts on the upper surface side to the wefts on the lower surface side is 3:2.

Figure 6:
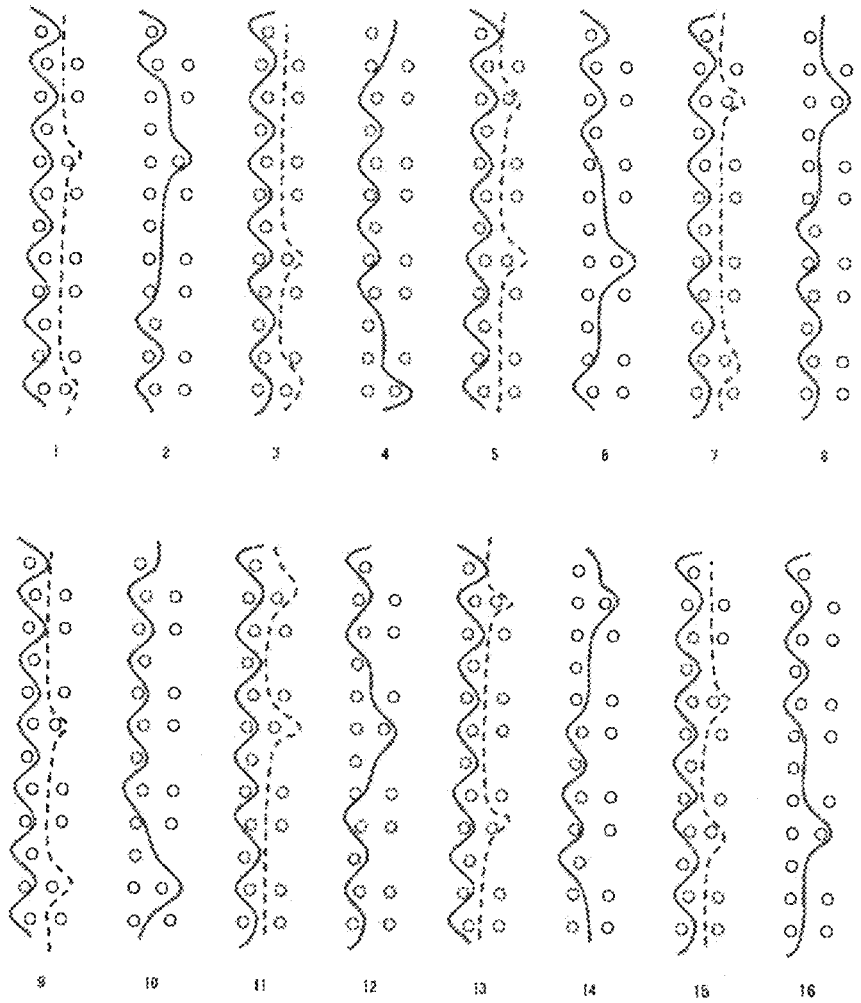
FIG. 6 is a design view showing a condition of the warps the third embodiment according to the present invention.

More specifically, as shown in FIG. 6, the warps on the upper surface side 1U and 2Ub, 3U and 4Ub, 5U and 6Ub, 7U and 8Ub, 9U and 10Ub, 11U and 12Ub, 13U and 14Ub, and 15U and 16Ub form a pair to constitute a structure of the fabric on the upper surface side. The warp 1U on the upper surface side forms a plain fabric of 1/1. The binding warp 2Ub forming a pair with the warp 1U passes above the wefts 1'U,3'U on the upper surface side, below the weft 2'L on the lower surface side, above the weft 11'U on the upper surface side.

The warp 3U on the upper surface side forms a plain fabric of 1/1. The binding warp 4Ub forming a pair with the warp 3U passes below the weft 1'L on the lower surface side, and above the wefts 4'U, 6'U, 8'U, 10'U on the upper surface side.

The warp 5U on the upper surface side forms a plain fabric of 1/1. The binding warp 6Ub forming a pair with the warp 5U passes above the weft 1'U on the upper surface side, below the weft 5'L on the lower surface side, and above the wefts 9'U,11'U on the upper surface side.

The warp 7U on the upper surface side forms a plain fabric of 1/1. The binding warp 8Ub forming a pair with the warp 7U passes above the wefts 2'U, 4'U,6'U on the upper surface side, and below the weft 10'L on the lower surface side.

In addition, the warp 9U on the upper surface side forms a plain fabric of 1/1. The binding warp 10Ub forming a pair with the warp 9U passes below the weft 2'L on the lower surface side, and above the weft 2'U, 5'U, 7'U,9'U,11'U on the upper surface side.

The warp 11U on the upper surface side forms a plain fabric of 1/1. The binding warp 12Ub forming a pair with the warp 11U passes above the wefts 2'U, 4'U on the upper surface side, below the weft 7'L on the lower surface side, and above the wefts 10'U, 12'U on the upper surface side.

The warp 13U on the upper surface side forms a plain fabric of 1/1. The binding warp 14Ub forming a pair with the warp 13U passes above the wefts 3'U, 5'U,7'U on the upper surface side, and below the weft 11'L on the lower surface side.

The warp 15U on the upper surface side forms a plain fabric of 1/1. The binding warp 16Ub forming a pair with the warp 15U passes below the weft 4'L on the lower surface side, above the weft 8'U,10'U,12'U on the lower surface side, above the wefts 7'U,8'U on the upper surface side, and below the wefts 9'U,10'U on the upper surface side.

In the third embodiment, by adopting the ribbed cord fabric as a part of the surface of the fabric on the upper surface side, a fabric with a thinned thickness which exhibits excellent rigidity, good anti-extension property, good wear resistance, good hydration property and good surface smoothness property, like a fabric forming a surface structure by flat yarns can be provided.

In addition, by adopting the fabric structure of the third embodiment, since the size of the mesh can be reduced without the thickness of the fabric being enhanced, the hydration property can be adjusted by a selection of the diameter of the yarns.

Still further, by two ribbed cord portions, since stress on the lateral yarns by which knuckles are retracted can be alleviated, the density of the lateral yarns can be largely improved.

Fourth Embodiment

Figure 7:
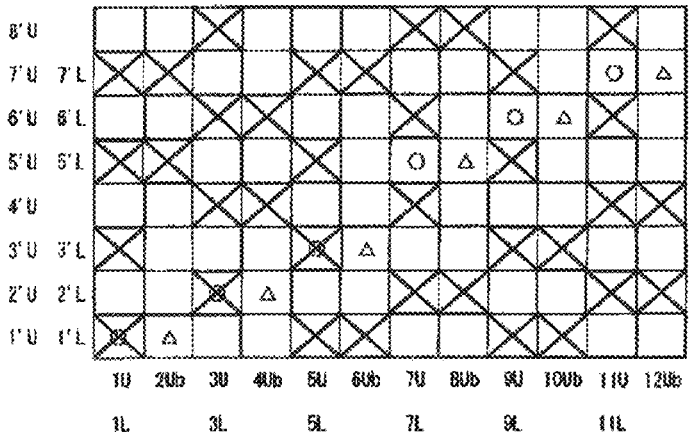
FIG. 7 is a design view showing a complete structure of the fourth embodiment according to the present invention.

FIG. 7 is a design view showing an industrial two-layer fabric according to the fourth embodiment. One of the warps on the upper surface side forming a pair in the fourth embodiment is the warp binding yarn. A part of the yarns are arranged to be in parallel so as to form a cord rib in the pairs of the warps on the upper surface side. The ratio of the wefts on the upper surface side to the wefts on the lower surface side is 4:3.

Figure 8:
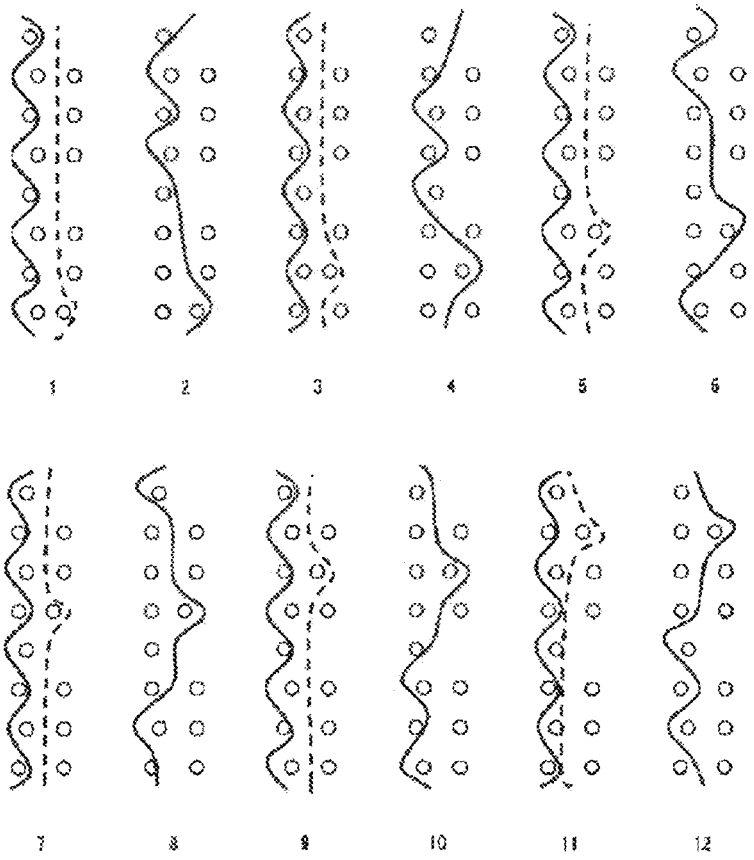
FIG. 8 is a design view showing a condition of the warps the fourth embodiment according to the present invention.

More specifically, as shown in FIG. 8, the warps on the upper surface side 1U and 2Ub, 3U and 4Ub, 5U and 6Ub, 7U and 8Ub, 9U and 10Ub, 11U and 12Ub form a pair to constitute a structure of the fabric on the upper surface side.

The warp 1U on the upper surface side forms a plain fabric of 1/1. The binding warp 2Ub forming a pair with the warp 1U passes below the weft 1'L on the lower surface side, and above the wefts 5'U,7'U on the upper surface side.

The warp 3U on the upper surface side forms a plain fabric of 1/1. The binding warp 4Ub forming a pair with the warp 3U passes below the weft 2'L on the lower surface side, and above the wefts 4'U, 6'U on the upper surface side.

The warp 5U on the upper surface side forms a plain fabric of 1/1. The binding warp 6Ub forming a pair with the warp 5U passes above the weft 1'U on the upper surface side, below the weft 3'L on the lower surface side, and above the weft 7'U on the upper surface side.

The warp 7U on the upper surface side forms a plain fabric of 1/1. The binding warp 8Ub forming a pair with the warp 7U passes above the weft 2'U on the upper surface side, below the weft 5'L on the lower surface side, and above the weft 8'U on the upper surface side.

In addition, the warp 9U on the upper surface side forms a plain fabric of 1/1. The binding warp 10Ub forming a pair with the warp 9U passes above the wefts 1'U, 3'U on the upper surface side, and below the weft 6'L on the lower surface side.

The warp 11U on the upper surface side forms a plain fabric of 1/1. The binding warp 12Ub forming a pair with the warp 11U passes above the wefts 2'U, 4'U on the upper surface side, and below the weft 7L on the lower surface side.

In the fourth embodiment, by adopting the ribbed cord fabric as a part of the surface of the fabric on the upper surface side, a fabric with a thinned thickness which exhibits excellent rigidity, good anti-extension property, good wear resistance, good hydration property and good surface smoothness property, like a fabric forming a surface structure by flat yarns can be provided.

In addition, by adopting the fabric structure of the fourth embodiment, since the size of the mesh can be reduced without the thickness of the fabric being enhanced, the hydration property can be adjusted by a selection of the diameter of the yarns.

Still further, by two ribbed cord portions, since stress on the lateral yarns by which knuckles are retracted can be alleviated, the density of the lateral yarns can be largely improved.

Fifth Embodiment

Figure 9:
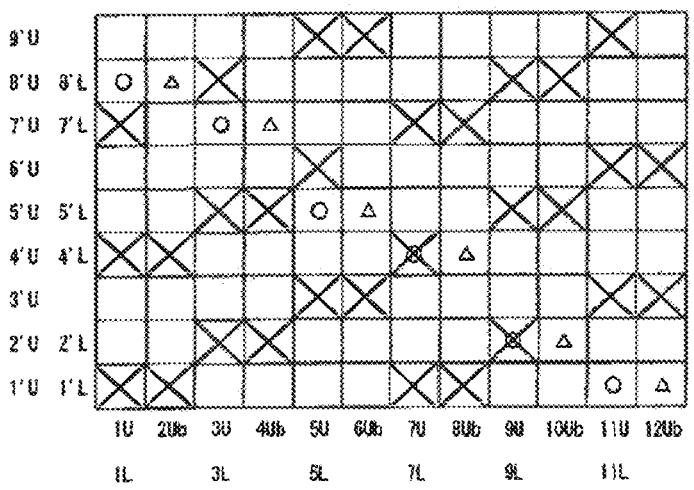
FIG. 9 is a design view showing a complete structure of the fifth embodiment according to the present invention.

FIG. 9 is a design view showing an industrial two-layer fabric according to the fifth embodiment. One of the warps on the upper surface side forming a pair in the fifth embodiment is the warp binding yarn. A part of the yarns is arranged to be in parallel so as to form a cord rib in the pairs of the warps on the upper surface side. The ratio of the wefts on the upper surface side to the wefts on the lower surface side is 3:2.

In addition, in the pairs of the warps on the upper surface side one of which is the warp binding yarn, 50% of the knuckles are arranged to be in parallel on the surface.

Figure 10:
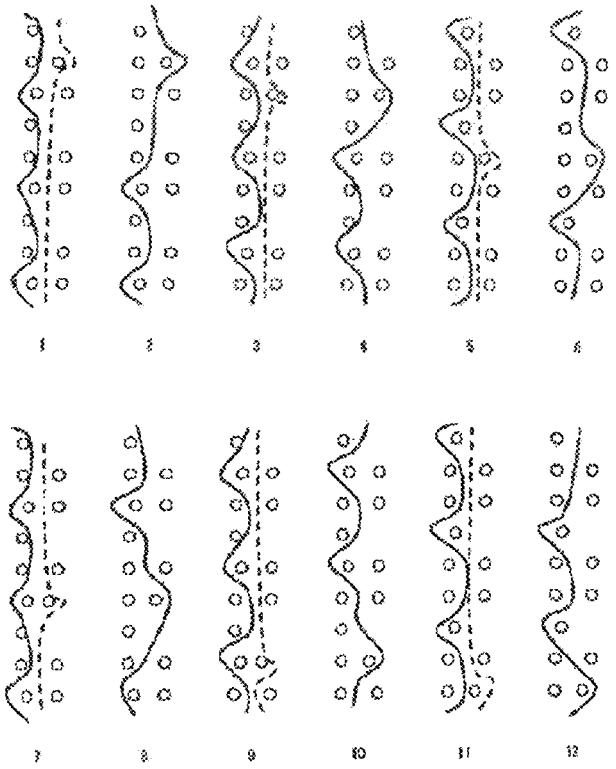
FIG. 10 is a design view showing a condition of the warps the fifth embodiment according to the present invention.

More specifically, as shown in FIG. 10, the warps on the upper surface side 1U and 2Ub, 3U and 4Ub, 5U and 6Ub, 7U and 8Ub, 9U and 10Ub, 11U and 12Ub form a pair to constitute a structure of the fabric on the upper surface side.

The warp 1U on the upper surface side forms a plain fabric of ½. The binding warp 2Ub forming a pair with the warp 1U passes above the weft 1'U, 4'U on the upper surface side, and below the weft 8'L on the lower surface side.

The warp 3U on the upper surface side forms a plain fabric of 1/1. The binding warp 4Ub forming a pair with the warp 3U passes above the wefts 2'U, 5'U on the upper surface side, and below the weft 7'L on the lower surface side.

The warp 5U on the upper surface side forms a plain fabric of ½. The binding warp 6Ub forming a pair with the warp 5U passes above the weft 3'U on the upper surface side, below the weft 5'L on the lower surface side, and above the weft 9'U on the upper surface side.

The warp 7U on the upper surface side forms a plain fabric of ½. The binding warp 8Ub forming a pair with the warp 7U passes above the weft 1'U on the upper surface side, below the weft 4'L on the lower surface side, and above the weft 7'U on the upper surface side.

In addition, the warp 9U on the upper surface side forms a plain fabric of ½. The binding warp 10Ub forming a pair with the warp 9U passes below the weft 2'L on the lower surface side, and above the wefts 5'U, 8'U on the upper surface side.

The warp 11U on the upper surface side forms a plain fabric of ½. The binding warp 12Ub forming a pair with the warp 11U passes below the weft 1'L on the lower surface side, and above the wefts 3'U, 6'U on the upper surface side.

In the fifth embodiment, by adopting the ribbed cord fabric as a part of the surface of the fabric on the upper surface side, a fabric with a thinned thickness which exhibits excellent rigidity, good anti-extension property, good wear resistance, good hydration property and good surface smoothness property, like a fabric forming a surface structure by flat yarns can be provided.

In addition, by adopting the fabric structure of the fifth embodiment, since the size of the mesh can be reduced without the thickness of the fabric being enhanced, the hydration property can be adjusted by a selection of the diameter of the yarns.

Still further, by two ribbed cord portion, since stress on the lateral yarns by which knuckles are retracted can be alleviated, the density of the lateral yarns can be largely improved.

Sixth Embodiment

Figure 11:
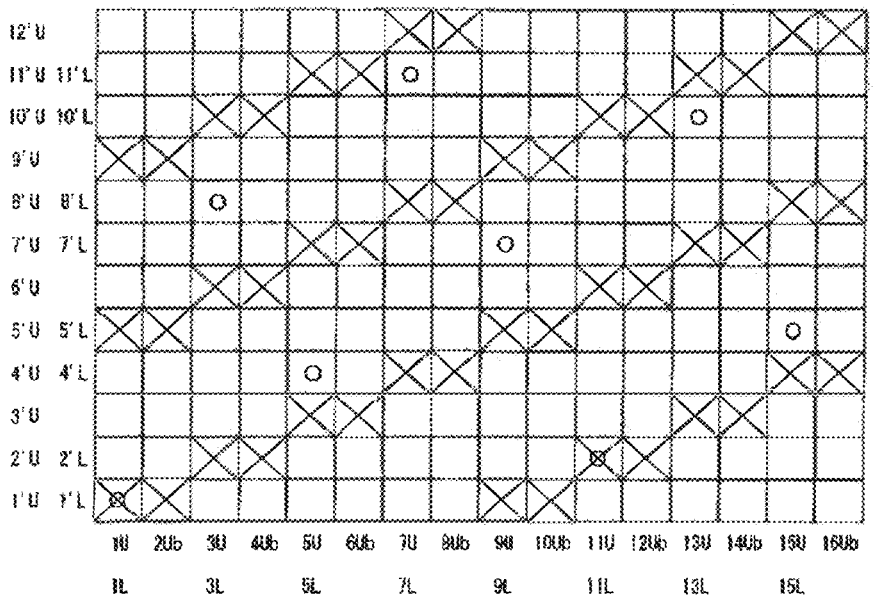
FIG. 11 is a design view showing a complete structure of the sixth embodiment according to the present invention.

FIG. 11 is a design view showing an industrial two-layer fabric according to the sixth embodiment. One of the warps on the upper surface side forming a pair in the sixth embodiment is the warp binding yarn. A part of the yarns are arranged to be in parallel so as to form a cord rib in the pairs of the warps on the upper surface side. The ratio of the wefts on the upper surface side to the wefts on the lower surface side is 3:2.

More specifically, as shown in FIG. 11, the warps on the upper surface side 1U and 2Ub, 3U and 4Ub, 5U and 6Ub, 7U and 8Ub, 9U and 10Ub, 11U and 12Ub, 13U and 14Ub, and 15U and 16Ub form a pair.

In the sixth embodiment, by adopting the ribbed cord fabric as a part of the surface of the fabric on the upper surface side, a fabric with a thinned thickness which exhibits excellent rigidity, good anti-extension property, good wear resistance, good hydration property and good surface smoothness property, like a fabric forming a surface structure by flat yarns can be provided.

In addition, by adopting the fabric structure of the sixth embodiment, since the size of the mesh can be reduced without the thickness of the fabric being enhanced, the hydration property can be adjusted by a selection of the diameter of the yarns.

Still further, by two ribbed cord portion, since stress on the lateral yarns by which knuckles are retracted can be alleviated, the density of the lateral yarns can be largely improved.

Seventh Embodiment

Figure 12:
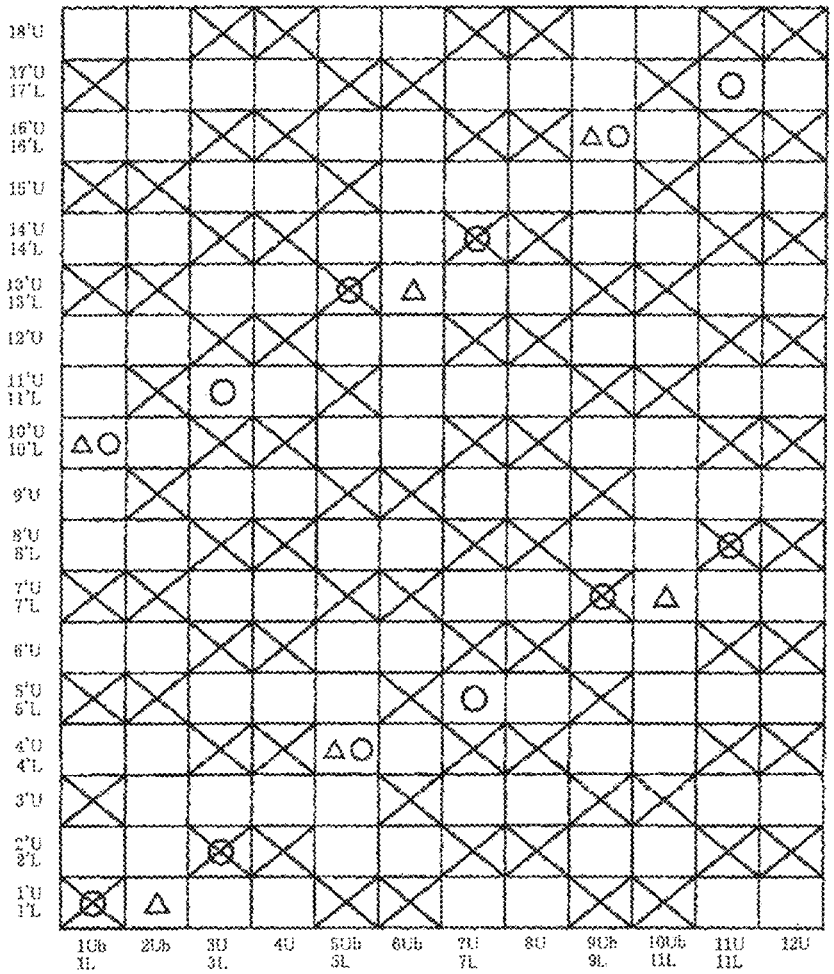
FIG. 12 is a design view showing a complete structure of the seventh embodiment according to the present invention.

FIG. 12 is a design view showing an industrial two-layer fabric according to the seventh embodiment. One of the warps on the upper surface side forming a pair in the seventh embodiment is the warp binding yarn. A part of the yarns is arranged to be in parallel so as to form a cord rib in the pairs of the warps on the upper surface side. The ratio of the wefts on the upper surface side to the wefts on the lower surface side is 3:2.

More specifically, as shown in FIG. 12, the warps on the upper surface side 1Ub and 2Ub, 3U and 4Ub, 5Ub and 6Ub, 7U and 8U, 9Ub and 10Ub, 11U and 12U form a pair to constitute a structure of the fabric on the upper surface side. The warp 1Ub on the upper surface side passes above the weft 1'U, 3'U, 5'U, 7'U on the upper surface side, below the weft 10'L on the lower surface side, and above the wefts 13'U,15'U,17'U on the upper surface side. The binding warp 2Ub forming a pair with the warp 1Ub passes above the weft 5'U, 7'U, 9'U, 11'U, 13'U, 15'U on the upper surface side, and below the weft 1'L on the lower surface side. Adjacent warp winding yarns 1Ub and 2Ub are constituted by the ribbed cord fabric at a portion of the knuckles (5'U, 7'U and 13'U, 15'U) emerging on the front surface side so as to be arranged in parallel. In addition, adjacent warp winding yarns 1Ub and 2Ub are replaced at the portion in parallel by the ribbed cord fabric. Still further, in the pair of warps 3U, 4U, all the yarns are woven as the ribbed cord fabric so as to be arranged in parallel, the warp 3L on the lower surface side passes below the wefts 2'L,11'L on the lower surface side.

The warp 5Ub on the upper surface side passes above the weft 7'U, 9'U,11'U, 13'U,15'U, 17'U on the upper surface side, below the weft 4'L on the lower surface side. The binding warp 6Ub forming a pair with the warp 5Ub passes above the weft 17'U, 1'U, 3'U, 5'U, 7'U, 9'U on the upper surface side, and below the weft 13'L on the lower surface side. Adjacent warp winding yarns 5Ub and 6Ub are constituted by the ribbed cord fabric at a portion of the knuckles (7'U, 9'U and 17'U, 1'U) emerging on the front surface side so as to be arranged in parallel. In addition, adjacent warp winding yarns 5Ub and 6Ub are replaced at the portion in parallel by the ribbed cord fabric.

Still further, in the pair of warps 7U, 8U, all the yarns are woven as the ribbed cord fabric so as to be arranged in parallel, the warp 7L on the lower surface side passes below the wefts 5'L,14'L on the lower surface side.

The warp 9Ub on the upper surface side passes above the weft 1'U, 3'U, 5'U, 7'U, 9'U,11'U, 13'U on the upper surface side, and below the weft 16'L on the lower surface side. The binding warp 10Ub forming a pair with the warp 9Ub passes above the weft 11'U, 13'U, 15'U, 17'U, 1'U, 3'U on the upper surface side, and below the weft 7'L on the lower surface side. Adjacent warp winding yarns 9Ub and 10Ub are constituted by the ribbed cord fabric at a portion of the knuckles (1'U, 3'U and 11'U, 13'U) emerging on the front surface side so as to be arranged in parallel. In addition, adjacent warp winding yarns 9Ub and 10Ub are replaced at the portion in parallel by the ribbed cord fabric.

Still further, in the pair of warps 11U, 12U, all the yarns are woven as the ribbed cord fabric so as to be arranged in parallel, the warp 11L on the lower surface side passes below the wefts 8'L,17'L on the lower surface side.

In the seventh embodiment, by adopting the ribbed cord fabric as a part of the surface of the fabric on the upper surface side, a fabric with a thinned thickness which exhibits excellent rigidity, good anti-extension property, good wear resistance, good hydration property and good surface smoothness property, like a fabric forming a surface structure by flat yarns can be provided.

In addition, by adopting the fabric structure of the seventh embodiment, since the size of the mesh can be reduced without the thickness of the fabric being enhanced, the hydration property can be adjusted by a selection of the diameter of the yarns.

Still further, by two ribbed cord portion, since stress on the lateral yarns by which knuckles are retracted can be alleviated, the density of the lateral yarns can be largely improved.

EXPLANATION OF SYMBOLS

1~16 warp

1'~18' weft

What is claimed is:

1. An industrial two-layer fabric comprising, in a complete structure:

an upper surface side fabric constituted by upper surface side warps and upper surface side wefts, a lower surface side fabric constituted by lower surface side warps and lower surface side wefts, wherein:

the upper surface side warps comprise a first pair that consists of two of the adjacent upper surface side warps, a first upper surface side warp of the first pair passes above and below the upper surface side wefts only, a second upper surface side warp of the first pair is a warp binding yarn that passes above one of the upper surface side wefts and passes below one of the lower surface side wefts, the second upper surface side warp passes below at least three of the adjacent upper surface side wefts where the second upper surface side warp passes below the one of the lower surface side wefts, a ratio of a number of the upper surface side warps to a number of the lower surface side warps is 2:1.

2. The industrial two-layer fabric according to claim 1:

the upper surface side warps comprise a second pair that consists of two of the adjacent upper surface side warps, the second pair does not include the warp binding yarn.

3. The industrial two-layer fabric according to claim 1, the first upper surface side warp pass over one of the upper surface side wefts and the second upper surface side warp pass over the one of the upper surface side wefts thereby forming a ribbed cord fabric.

4. The industrial two-layer fabric according to claim 1, the two upper surface side warps of the first pair pass over one of the upper surface side wefts in parallel.

5. The industrial two-layer fabric according to claim 1:

the upper surface side warps comprise a third pair that consists of two of the adjacent upper surface side warps that are warp binding yarns arranged in parallel.

6. The industrial two-layer fabric according to claim 3, the two upper surface side warps of the first pair pass over 50% or more of the upper surface side wefts in parallel.

7. The industrial two-layer fabric according to claim 1, the diameter of the upper surface side warps are set to be the same, while, the diameter of the lower surface side warps are set to be the same, and the ratios of a diameter of the lower surface side warps to a diameter of the upper surface side warps is 150% to 300%.

8. The industrial two-layer fabric according to claim 1, a longitudinal density of the upper surface side warps is 40% to 60%, while a density of the lower surface side warps is 40% to 55%.

* * * * *